United States Patent [19]

Banister et al.

[11] Patent Number: 4,555,316

[45] Date of Patent: Nov. 26, 1985

[54] SYNTHESIS OF POLY(SULPHUR NITRIDE)

[75] Inventors: Arthur J. Banister, Durham; Zdenek V. Hauptman, Bishop Auckland; Aidan G. Kendrick, Stockport, all of England

[73] Assignee: National Research Development Corporation, London, England

[21] Appl. No.: 637,829

[22] Filed: Aug. 6, 1984

[30] Foreign Application Priority Data

Aug. 23, 1983 [GB] United Kingdom ..... 8322621

[51] Int. Cl.[4] ..... C25C 3/00

[52] U.S. Cl. ..... 204/59 R; 204/59 M; 423/406

[58] Field of Search ..... 204/59 R, 59 M; 528/381, 388; 423/406

[56] References Cited

U.S. PATENT DOCUMENTS

| | | | |
|---|---|---|---|
| 3,040,098 | 6/1962 | Stone | 528/381 |
| 3,742,058 | 6/1973 | Shim | 528/381 |
| 4,268,491 | 5/1981 | Banister et al. | 423/406 |

*Primary Examiner*—John F. Niebling

*Attorney, Agent, or Firm*—Oblon, Fisher, Spivak, McClelland & Maier

[57] ABSTRACT

Crystalline poly(sulphur nitride) is deposited electrochemically at a bright platinum sheet cathode by electrolyzing solution of $S_5N_5Cl$ in liquid $SO_2$.

15 Claims, No Drawings

SYNTHESIS OF POLY(SULPHUR NITRIDE)

This invention relates to a method of synthesizing poly(sulphur nitride), $(SN)_x$.

Poly(sulphur nitride) is a quasi one-dimensional polymer with both metallic properties (such as high electrical conductivity and superconductivity below 0.3K) and a high work function for electrons. Coatings of it may therefore find application in devices such as photovoltaic components of solar cells, light-emitting diodes, film electrodes for polarography, catalysts and Schottky barriers generally.

A variety of synthetic methods is available, for example solid-state polymerization of $S_2N_2$; decomposing $S_4N_4$ and irradiating the decomposition products; and solution preparation involving azides.

According to the present invention, a method of synthesizing crystalline poly(sulphur nitride) comprises electrolyzing a solution of $(S_mN_n)_z^{p+}X_y^{q-}$ where m is an integer such as 3, 4 or 5; n=m or m−1; X is an anion; and p is the number of units of charge on the cation $(S_mN_n)$; q is the number of units of charge on the anion X; y is the number of the anions, z is the number of the cations; and, to preserve electroneutrality, pz=qy; whereby poly(sulphur nitride) is electrodeposited, usually at the cathode but sometimes at the anode also. Preferably m=n=5, or m=4 and n=3. X, the anion, preferably comprises no metal, and thus may be for example a halide, e.g. chloride. However X may nonetheless permissibly be a complex anion, which may contain a metal, such as $(FeCl_4)^-$, $(AlCl_4)^-$ or $(BF_4)^-$. Where X contains no metal, the possibility of metallic contamination of the poly(sulphur nitride) from this source cannot arise. The solvent should be one which is inactive towards poly(sulphur nitride), and may contain a conductivity assistant such as lithium perchlorate.

The anode is preferably of platinum, and the cathode is for instance platinum, gold or 'glassy' carbon. The cathode may alternatively be of conductively coated (e.g. tin-oxide-coated) glass.

The current density on the cathode is preferably from 0.05 to 5.0 mA $cm^{-2}$, more preferably from 0.1 to 1.5 mA $cm^{-2}$.

This electrochemical route is capable of scaling up without introducing hazardous quantities of explosive feedstock and is well amenable to control. Typical convenient solvents (normally aprotic) are acetonitrile and (liquid) sulphur dioxide. Sulphur dioxide has some advantages over acetonitrile in that it can be made anhydrous relatively easily; water attacks $(SN)_x$.

The invention will now be described by way of example.

EXAMPLE 1

In this example, we prepared and then electrolyzed $S_5N_5Cl$.

Cyclopentathiazenium tetrachloroferrate(III), $S_5N_5FeCl_4$, was prepared either from iron powder and $(NSCl)_3$ in nitromethane, or from $S_4N_4$, $(NSCl)_3$ and $FeCl_3$ in thionyl chloride solution. We prepared $S_5N_5Cl$, in liquid $SO_2$, at 18° C. from the $S_5N_5FeCl_4$ and CsF (molar ratio 1:3). Co-products ($S_4N_4$ and CsCl) were removed by extraction with acetonitrile, in which $S_5N_5Cl$ is only sparingly soluble. Purified $S_5N_5Cl$ can be stored in an inert atmosphere without decomposition. $S_5N_5Cl$ is moderately soluble in liquid $SO_2$ (ca. 0.03 g/g $SO_2$ at 18° C.). Like $S_4N_4$ and $(SN)_x$ it detonates on percussion; it is less sensitive to shock than $S_4N_4$. Hydrolysis of $S_5N_5Cl$ occurs only slowly in air to give a black mixture, containing $S_4N_4$, $(NH_4)_2SO_4$ and $(SN)_x$. All operations involving air-sensitive materials were carried out in a glove box and all glassware was freshly heated to ca. 550° C. either in an annealing oven or by a hand torch.

The electrolysis was carried out in a simple undivided cell. The working electrode (cathode) was shiny platinum foil (4.0 $cm^2$ area). The auxiliary electrode (anode) was coiled platinum wire (0.5 mm diameter). $S_5N_5Cl$ (0.160 g, 0.60 mmol) and a magnetic stirring bar were put into the cell in the glove box; the cell was assembled and removed from the box. Sulphur dioxide (21 g) was condensed in under 3 atmospheres pressure via a metal vacuum line. On warming to room temperature the $S_5N_5Cl$ dissolved to give a pale yellow solution of ca. $4.1\times10^{-3}$ mol $dm^{-3}$ concentration. The cell was placed into a thermostated bath (at −1° C.) above a magnetic stirrer and was connected to a stabilized d.c. source. The current was adjusted to 4.0 mA (i.e., nominal current density 1.0 mA $cm^{-2}$); the potential measured across the electrodes was 2.6 V. For the first 10 minutes the reaction proceeded without stirring and an even black film formed almost immediately on the cathode's front surface (i.e., facing the anode) together with a brown turbid cloud in the electrolyte. After 10 minutes the stirrer was turned on, the turbidity disappeared and a steady growth ensued. Throughout the electrolysis (4 hours) the current and the potential fluctuated by no more than about 2% and no gas evolution occurred. The solid residue at the bottom of the cell after evaporation of the solvent was a mixture of $S_5N_5Cl$ (as a major component) and $S_4N_4$. The cathodic deposit on the front side was microcrystalline $(SN)_x$ interspersed with minute $S_4N_4$ crystals. The reverse side of the cathode was coated with a continuous thin blue layer of $(SN)_x$. The $S_4N_4$ was removed by sublimation at 60° C. in vacuo ($\leqq10^{-6}$ Torr). Under an optical microscope (40x) the fragmented deposit of purified polymer appeared composed of bright gold highly reflecting microcrystals of about 10 micrometers average size (and a very few needles, up to 0.5 mm in length). These microcrystals were stacked in zig-zag chains arranged at right angles with respect to the electrode surface.

The product poly(sulphur nitride) was identified by chemical analysis (S theoretical 69.60, found 69.17; N theoretical 30.40, found 30.85), infra-red spectroscopy and X-ray powder diffraction. Currency efficiency was 0.7 SN units per electron.

EXAMPLE 2

Example 1 was repeated except for some changes to the electrolytic conditions. Thus, the current density was 7.5 mA $cm^{-2}$ on a cathode of 0.5 mm-diameter platinum wire, total current was 8.0 mA, and potential between the electrodes 3.0 V. The concentration in the undivided cell of the $S_5N_5Cl$ was $4.8\times10^{-3}$ mol $dm^{-3}$. A black film formed almost immediately and a transient dark brown turbid wake formed in the vicinity of the cathode in the direction of the electrolyte motion. The duration of the electrolysis was 2 hours after which time evaporation of the solvent gave $S_5N_5Cl$ and $S_4N_4$. The cathodic deposite was microcrystalline polymeric $(SN)_x$ interspersed with minute $S_4N_4$ crystals; these crystals were removed by sublimation at 60° C. in vacuo ($\leqq10^{-6}$ Torr). Under an optical microscope (40x) the fragmented deposit of the purified polymer appeared composed of bright gold highly reflecting microcrystals. These crystals were stacked in zig-zag chains arranged radially around the Pt wire. A scanning electron micrograph image shows stacks of rounded, 4–5 micrometer microcrystals looking obliquely down the chain-like stacks. The deposit also contained a few needles of $(SN)_x$ about 10 micrometers cross-section and 0.5 mm length.

Pumping on the polymer removed $S_4N_4$. The final $(SN)_x$ was identified as in Example 1.

EXAMPLE 3

Poly(sulphur nitride) was prepared electrochemically in a two-compartment (permeable glass frit divider) electrolytic cell from 0.015 g cyclopentathiazenium tetrachloroaluminate, $S_5N_5AlCl_4$, dissolved in 40 $cm^3$ acetonitrile at 0.9 mA on a gold cathode (current density 0.7 mA $cm^{-2}$) with a potential of 26.5 V between the electrodes for a duration of 7 hours (with stirring). The yield was 23.8 mg poly(sulphur nitride) $(SN)_x$, i.e. 2.1 (SN) units per electron.

EXAMPLE 4

Poly(sulphur nitride) was prepared electrochemically from cyclopentathiazenium tetrachloroferrate(III), $S_5N_5FeCl_4$ (0.300 g) dissolved in acetronitrile (40 $cm^3$) using a two-compartment electrolytic cell, with platinum foil as cathode and anode, a potential difference of 26.5 V and a current density of ca. 0.5 mA $cm^{-2}$.

$(SN)_x$ is deposited, albeit contaminated with iron(III) chloride (liberated during the electrolysis).

EXAMPLE 5

Poly(sulphur nitride), in the form of an even thin film on a bright platinum cathode, was prepared electrochemically from cyclotetrathiatriazenium tetrafluoroborate $S_4N_3BF_4$ (0.20 g) in acetonitrile (40 $cm^3$) using a two-compartment cell, an iron (6 mm rod) anode and the following conditions: potential drop across the cell ca. 2.5 V, current 2.0 mA, cathodic current density ca. 1.5 mA $cm^{-2}$, temperature −1° C. and time 3 hours 15 minutes. At comparable concentrations in acetonitrile, $S_4N_3BF_4$ is an order of magnitude more conductive than $S_5N_5AlCl_4$. Moreover, in general, $S_4N_3^+$ salts are easy to make and are among the most stable of all S/N compounds.

As soon as the current was turned on, the pale yellow colour of the solution in the cathode compartment changed to blue-green and a shiny black deposit formed at the anode, later becoming gold; a similar black deposit appeared at the cathode after ca. 15 minutes. The beginning of cathodic deposition was accompanied by the return of the original yellow colour of the cathodic solution which, while remaining clear, gradually darkened (over 3 hours) to orange-brown.

The darkening of the cathodic solution was attributed to the formation of $S_4N_2$, which was isolated from the solid residue remaining after evaporation of the electrolyte. The gold-coloured coating of $(SN)_x$ was removed from the anode with alkali (10% KOH in 1:1 water:ethanol); examination of the iron surface under a microscope showed no sign of corrosion. (The iron thus appears not to participate in the reaction and not to be present contaminating the product.) The product formed a coherent film on both electrodes with no tendency to spill off.

EXAMPLE 6

In this example, we obtained compact layers of $(SN)_x$, several micrometers thick, by potentiostatically controlled electrolysis of $S_5N_5BF_4$.

The electrolyte was $S_4N_5BF_4$ (0.2 g, 0.63 mmole) in 40 ml of a 0.1M lithium perchlorate $LiClO_4$ solution in acetonitrile $CH_3CN$. The cathode was a bright platinum sheet of total area 2.8 $cm^2$ (1.4 $cm^2$ each side). The reference electrode was $Ag/Ag^+$ (0.1M); its potential against the standard calomel electrode was +0.26 V at room temperature. The cathodic and the anodic compartment were separated by a porous glass sinter. The anode was a platinum strip $1\frac{1}{2}$ mm broad, $\frac{1}{2}$ mm thick and 5 cm long, formed into a coil.

Electrodeposition of $(SN)_x$ on the platinum sheet took place at 0° C. and at a potential held at zero against the standard calomel electrode in unstirred solution, with a cell current of approximately 0.5 mA flowing through the cell for 4 hours, with a current density for deposition on the cathode of about 0.18 mA $cm^{-2}$. The resulting deposit on both sides of the cathode was a compact reflective gold-bronze layer of $(SN)_x$.

EXAMPLE 7

Example 6 was repeated, except for using a different cathode, namely a 3-micrometer thick layer of $(SN)_x$ vapour-deposited on both sides of a glass slide of total area 2.8 $cm^2$ (1.4 $cm^2$ each side). Also, the temperature was changed to 20° C., and the cathode was in this example held potentiostatically at +0.220 V against the standard calomel electrode in an unstirred solution. A current of approximately 0.5 mA was passing through the cell. After 3 hours a dense gold-bronzy reflecting film about 8 micrometers thick had formed, coherently overgrowing the vapour-deposited $(SN)_x$ substrate.

What is claimed as new and desired to be secured by Letters Patent of the United States is:

1. A method of synthesizing crystalline poly(sulphur nitride), comprising electrolyzing a solution of $(S_mN_n)_z^{p+}X_y^{q-}$ where: m is an integer; n is one of m and m−1; X is an anion; and p is the number of units of charge on the cation $(S_mN_n)$; q is the number of units of charge on the anion X; y is the number of the anions, z is the number of the cations; and, to preserve electroneutrality, pz=qy, whereby poly(sulphur nitride) is electrodeposited.

2. A method according to claim 1, wherein m is one of 3, 4 and 5.

3. A method according to claim 2, wherein m=5 and n=5.

4. A method according to claim 2, wherein m=4 and n=3.

5. A method according to claim 1, wherein X is comprised wholly of non-metallic elements.

6. A method according to claim 5, wherein X is a halide.

7. A method according to claim 1, wherein X is a complex anion.

8. A method according to claim 7, wherein X is $(FeCl_4)^-$ or $(AlCl_4)^-$ or $(BF_4)^-$.

9. A method according to claim 1, wherein the poly(sulphur nitride) is electrodeposited on the cathode.

10. A method according to claim 9, wherein the current density on the cathode is from 0.05 to 5.0 mA $cm^{-2}$.

11. A method according to claim 1, wherein the poly(sulphur nitride) is electrodeposited on the anode.

12. A method according to claim 1, wherein the solvent is acetonitrile or liquid sulphur dioxide.

13. A method according to claim 1, wherein the solvent contains a conductivity assistant.

14. A method according to claim 1, wherein the anode is of platinum.

15. A method according to claim 1, wherein the cathode is of one of platinum, gold, carbon and conductively coated glass.

* * * * *